US005433540A

United States Patent [19]

Alday

[11] Patent Number: 5,433,540

[45] Date of Patent: Jul. 18, 1995

[54] COMBINED SPOOL RETAINER AND INSTALLATION DEVICE

[75] Inventor: James M. Alday, Honeoye Falls, N.Y.

[73] Assignee: Xerox Corporation, Stamford, Conn.

[21] Appl. No.: 205,393

[22] Filed: Mar. 3, 1994

[51] Int. Cl.[6] ..... B41J 35/00

[52] U.S. Cl. ..... 400/250; 400/196; 400/207

[58] Field of Search ..... 400/196, 207, 208, 250; 206/387, 393, 394, 391, 389, 397; 29/234, 806

[56] References Cited

U.S. PATENT DOCUMENTS

| | | | |
|---|---|---|---|
| 3,151,723 | 10/1964 | Wendt | 400/250 |
| 3,272,325 | 9/1966 | Schoenmakers . | |
| 3,380,581 | 4/1968 | Landgraf . | |
| 3,381,810 | 5/1968 | Lasher et al. . | |
| 4,119,200 | 10/1978 | Cassidy et al. . | |
| 4,140,219 | 2/1979 | Somers . | |
| 4,154,341 | 5/1979 | Osanai | 400/207 |
| 4,367,963 | 1/1983 | Daughters | 400/207 |
| 4,408,910 | 10/1983 | Masao | 400/207 |
| 4,757,896 | 7/1988 | Huko | 206/387 |
| 4,911,356 | 3/1990 | Townsend et al. | 206/509 |
| 5,207,367 | 5/1993 | Dunn et al. | 206/509 |

*Primary Examiner*—Edgar S. Burr
*Assistant Examiner*—John S. Hilten
*Attorney, Agent, or Firm*—Oliff & Berridge

[57] ABSTRACT

A spool retainer prevents the spools of a tape cartridge from unwinding during shipping or storage and also serves as an installation aid that remains on the cartridge during installation into a printing mechanism to retain and precisely locate the ribbon within the cartridge during installation. The retainer includes a substantially flat back wall; two spaced apart tabs projecting in a direction perpendicular to the back wall; and a protruding wall extending in the direction from a lower end of the back wall substantially parallel with the tabs. The two spaced apart tabs are adapted for mating with splines within spools of a ribbon cartridge and fixedly engage the splines to prevent relative movement between the spools. The protruding wall protects exposed ribbon during both storage and installation.

24 Claims, 5 Drawing Sheets

COMBINED SPOOL RETAINER AND INSTALLATION DEVICE

BACKGROUND OF THE INVENTION

1. Field of the Invention

The present invention relates to a spool retainer that prevents the two spools of a tape cartridge from unwinding during shipping or storage and also serves as an installation aid that remains on the cartridge during installation into a device such as a printing mechanism to retain and precisely locate the ribbon within the mechanism during installation.

2. Description of Related Art

In one type of thermal printing device, a thermal printhead presses a donor film ribbon, housed in a ribbon cartridge, onto the surface of a copy sheet. Such a device requires frequent replacement of the ribbon cartridge. The cartridge has an exposed ribbon surface that requires protection during storage prior to use to protect the ribbon and to prevent ink on the ribbon from contaminating the surroundings.

An additional problem associated with cartridges, and especially ribbon cartridges for small sized printers, is that there is usually only a very narrow space between a printhead and an opposing platen through which the exposed portion of the ribbon must pass when being installed on the printing device. Often, there is difficulty in installing such a cartridge even to a skilled user. Further, there is a need to protect and precisely locate and retain the exposed portion of ribbon during storage and during installation of the cartridge onto the printing device.

There are several known devices that provide a storage case or packaging for cartridges or cassettes that house spools of ribbon or magnetic media. Examples of these devices are described in U.S. Pat. No. 3,381,810 to Lasher et al., U.S. Pat. No. 4,119,200 to Cassidy et al., U.S. Pat. No. 3,272,325 to Schoenmakers, U.S. Pat. No. 4,140,219 to Somers, and U.S. Pat. No. 3,380,581 to Landgraf.

Known storage cases address the need to protect the cartridge during storage, but fail to appreciate the need to protect and retain the cartridge during installation. All of the identified prior art patents teach and require removal of the cassette or cartridge from its storage case prior to installation into a printing device. As such, they fail to protect and retain the cartridge at the crucial time immediately prior to and during installation.

SUMMARY OF THE INVENTION

It is an object of the present invention to retain and protect a ribbon cartridge, including the exposed ribbon in the cartridge during storage and during installation of the cartridge onto a device having a ribbon driving mechanism.

It is another object of the invention to protect the ribbon from unwinding off the spool during storage or installation.

It is another object of the invention to provide a retainer that aids in installation of a ribbon cartridge onto a ribbon driving mechanism.

These and other objects are achieved according to a first aspect of the invention by a ribbon cartridge and retaining device. The ribbon cartridge includes a ribbon cartridge housing of a predetermined size supporting a supply spool having a supply of ribbon wound therearound and a take-up spool. At least one side of the housing has apertures sized to expose driving splines of the supply spool and take-up spool. One end of the housing is formed so as to allow the ribbon to be exposed as it travels between the supply spool and the take-up spool so that the exposed ribbon can be engaged by a printhead of the printing mechanism, for example. A retaining device is removably engaged with the ribbon cartridge. The retaining device comprises a first wall, two spaced apart tabs projecting in a direction perpendicular to the first wall, and a protruding second wall extending in the direction from the first wall substantially parallel with the tabs. Each tab is sized and spaced to fit within respective ones of the apertures of the housing and engage one of the supply spool and take-up spool driving splines. When the retaining device and cartridge are mated, the tabs prevent the ribbon from unwinding so as to retain tension on the ribbon. This maintains the exposed portion of the ribbon in a flat plane, which prevents the ribbon from being damaged. The protruding wall extends adjacent to the one end of the housing so as to cover the exposed ribbon. A side of the housing opposite the side over which the first wall of the retainer is placed is completely exposed. This allows the ribbon cartridge to be inserted into a ribbon driving device, such as a printing mechanism, without prior removal of the retaining device.

The objects also are achieved by a method of installing a ribbon cartridge onto mounting elements of a printing device. The method comprises the steps of:

providing a retaining device having a first wall, two spaced apart tabs projecting perpendicular to the first wall in a direction and a protruding second wall extending from the first wall substantially in said direction, each of the tabs being sized and spaced to fit within respective apertures of the ribbon cartridge and engage splines within one of a supply spool and take-up spool;

attaching the retaining device onto the ribbon cartridge so that the tabs engage respective splines within the cartridge, the first wall is substantially adjacent a corresponding side of the cartridge and the protruding surface extends along and protects an exposed ribbon portion of the cartridge to define a cartridge having a completely exposed front side opposite the corresponding side adjacent the first wall of the retaining device, the tabs restraining rotational movement of the spools to maintain the exposed portion of the ribbon in a flat plane; and installing the ribbon cartridge onto a ribbon driving device mounting element while the retaining device is attached to the cartridge, the retaining device sliding out of engagement with the cartridge as the cartridge is installed.

These and other objects and features of the invention will become apparent from a reading of the following detailed description in connection with the drawings.

BRIEF DESCRIPTION OF THE DRAWINGS

The invention will be described in detail with reference to the following drawings wherein.

DETAILED DESCRIPTION OF PREFERRED EMBODIMENTS

Figure 1:
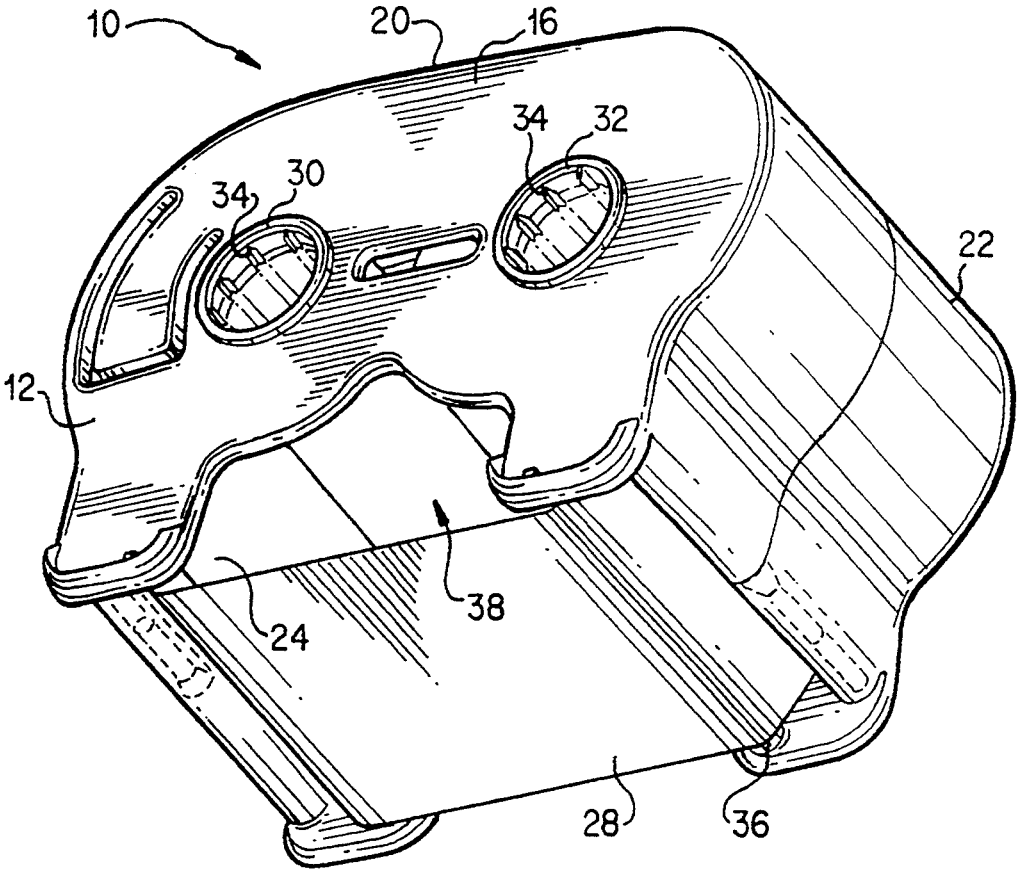
FIGS. 1 and 2 are perspective and exploded view, respectively, of a typical ribbon cartridge for use in a printing system such as a thermal printing system.
Figure 2:
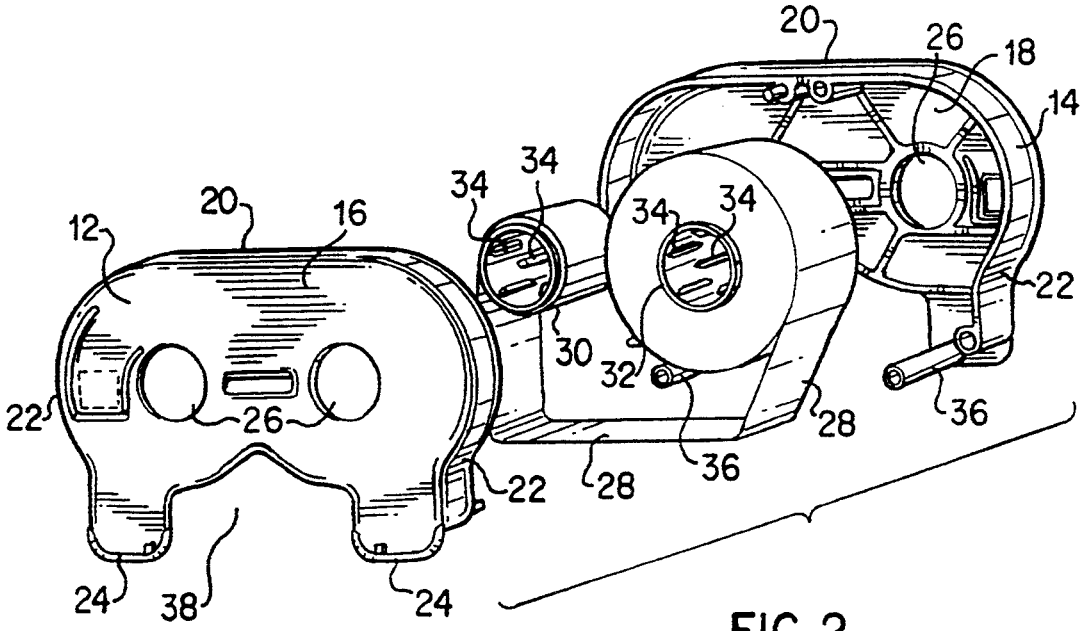

The invention relates to a spool retaining and installation device that retains and protects a cartridge such as the cartridge shown in FIG. 1. The illustrated embodiment shows the retaining and installation device used with a printing ribbon. It will become apparent from the following description that other types of ribbons such as audio and/or video recording ribbons may be used. A typical cartridge, such as a ribbon cartridge 10, includes front and back casings 12 and 14 defining a front wall 16, a back wall 18, a top wall 20, side walls 22 and an open bottom side 24 when attached together as shown in FIG. 1. Both the front wall 16 and back wall 18 include spaced apertures 26.

Within the casings 12 and 14 is a ribbon 28 wound between two spools 30, 32. Each spool 30, 32 is provided with splines 34 on an inner surface and acts as a supply reel and/or a take-up reel. The spools 30, 32 are aligned with apertures 26 so that splines 34 can mate with corresponding drive structures provided on a ribbon driving device when the cartridge is installed on the device. The ribbon driving device can be part of an audio and/or video playing/recording device or a printing device, for example. Thus, the ribbon could be an audio and/or video cassette, or a print ribbon cassette that contains a ribbon having ink on one surface. When a multi-pass ribbon is used, in which the ribbon is wound/unwound several times back-and-forth between spools 30 and 32 (usually after removing cartridge 10 from the printing device, turning it around, and then reinstalling the cartridge 10 in the printing device), both spools alternately function as a supply reel and a take-up reel.

Ribbon 28, which preferably includes one ink coated surface, is supported on and wrapped around the spools 30, 32 and moves from the supply spool to the take-up spool as a drive mechanism (not shown) located on a printing device rotates the take-up spool. The ink on ribbon 28 can be, for example, a thermally sensitive ink, a pressure sensitive ink, or a combination of both, depending on the type of printhead (e.g., thermal vs. daisy wheel) provided in the printing device. The ribbon 28 also could be other types of film such as audio or video tapes having magnetic film coatings. As shown, when the cartridge is assembled, an exposed portion of ribbon 28 extends along the exposed bottom side 24 of cartridge 10 and is constrained by guide rails 36. The cartridge 10 also is provided with a recess 38 between the exposed ribbon 28 and the central portion of cartridge 10. Recess 38 accommodates a printhead, such as, for example, a thermal transfer printhead that transfers ink from one surface of ribbon 28 to a print media such as paper. This recess could also accommodate a read head for audio or video tapes. The printhead can be provided in a variety of printing device, such as, for example, a printer, a typewriter or word-processor, or a portable copier such as disclosed, for example, in U.S. Pat. No. 5,187,588 to Denis J. Stemmle.

The exposed ribbon is under minimal tension when the splines 34 are not engaged within the printing device. As such, movements that occur during storage, shipping or during installation can cause the spools 30 and 32 to move relative to each other, causing a slack loop in the exposed ribbon 28. This slack during installation exposes the ribbon to paper or other print media in the printer device which is undesirable. The slack also causes difficulty when an attempt is made to install the cartridge in the printer device. Because of the narrow space provided between the printhead and the platen (on which the paper is located), the slack ribbon often cannot be accurately inserted into the space without wrinkling or deforming the ribbon. This results in tangled or damaged ribbon during installation attempts and often results in the inability to successfully install the cartridge.

Figure 3:
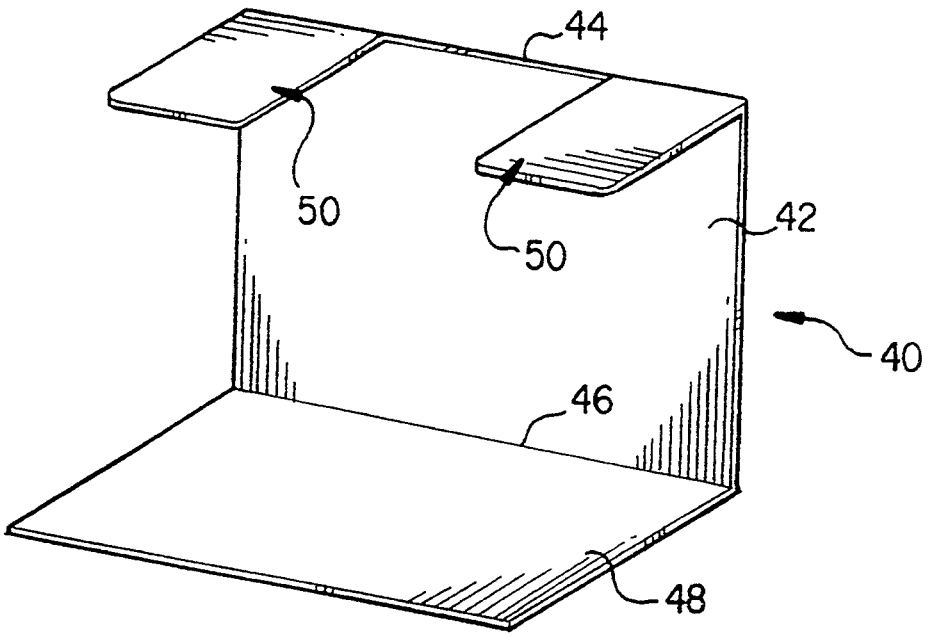
FIG. 3 shows a spool retaining and installation device according to a first embodiment of the invention.

FIG. 3 shows a spool retaining and installation device 40 according to a first embodiment of the invention that overcomes the problem with cartridge unwinding and cartridge installation. Spool retaining device 40 consists of a first support wall 42 having a top edge 44 and a lower edge 46, a protruding support wall 48 extending from the lower edge 46 substantially perpendicular to first support wall 42, and retaining tabs 50 located near the top edge 44 and extending perpendicular to first wall 42. Wall 48 and tabs 50 extend in the same direction from wall 42.

The retaining device 40 is attached to a cartridge 10 so that first wall 42 of the retaining device is against front wall 16 of the cartridge. Tabs 50 are sized and spaced to fit within the apertures 26 of the cartridge 10 and engage with splines 34. The fixed tabs 50 prevent rotation of the spools 30, 32 and retain a proper tension in the ribbon 28.

The tension in a free part of the ribbon 28 that extends between the two spools 30, 32 (across cartridge recess 38) tends to keep the ribbon straight and flat, allowing it to be inserted more easily into a narrow slit, even if the slit is of considerable depth. This tension, as previously stated, is provided by the tabs 50 engaging splines 34 and preventing unwinding of the ribbon 28.

According to this first embodiment, the first wall 42 is sized approximately one half the height of the front wall 16 of the cartridge 10. The protruding support wall 48 is of a length sufficient to cover and protect the ribbon 28, which is exposed between guide rails 36 on the cartridge 10. A preferred depth of wall 48 is a depth substantially the same as the depth of the cartridge, as measured in the axial direction of the spools.

Retaining device 40 can be manufactured from any suitable material. Preferably, the device according to the first embodiment is formed from a folded plastic sheet of approximately 0.020 inch (0.5 mm) thickness to provide rigidity to the retaining device. The retaining device 40 can be made from polycarbonate, styrene, or polyvinyl chloride, for example.

Figure 4:
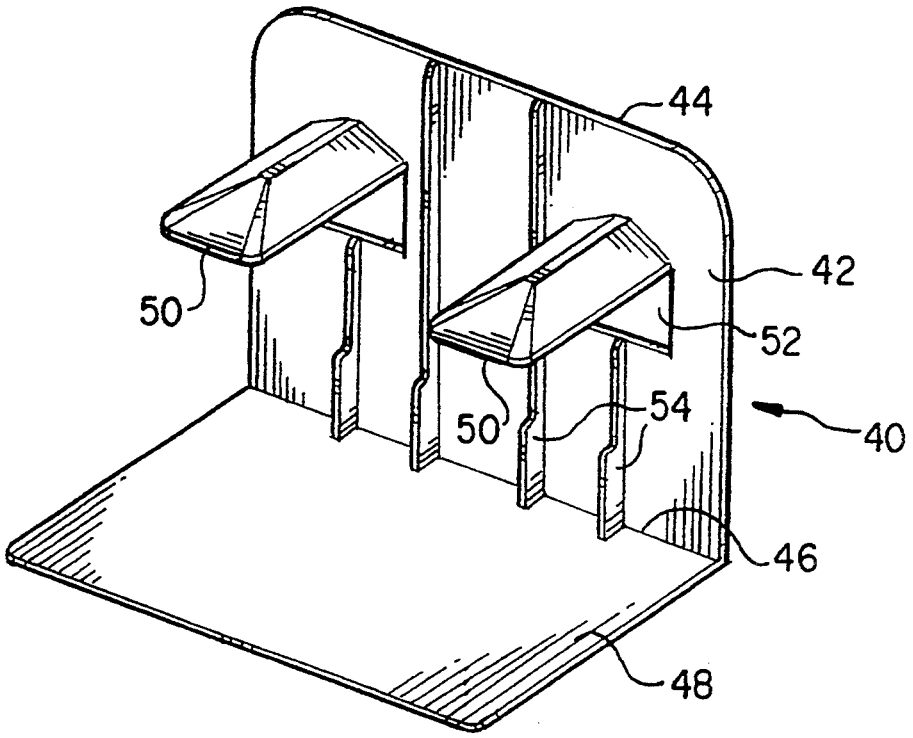
FIG. 4 shows a spool retaining and installation device according to a second embodiment of the invention.
Figure 5:
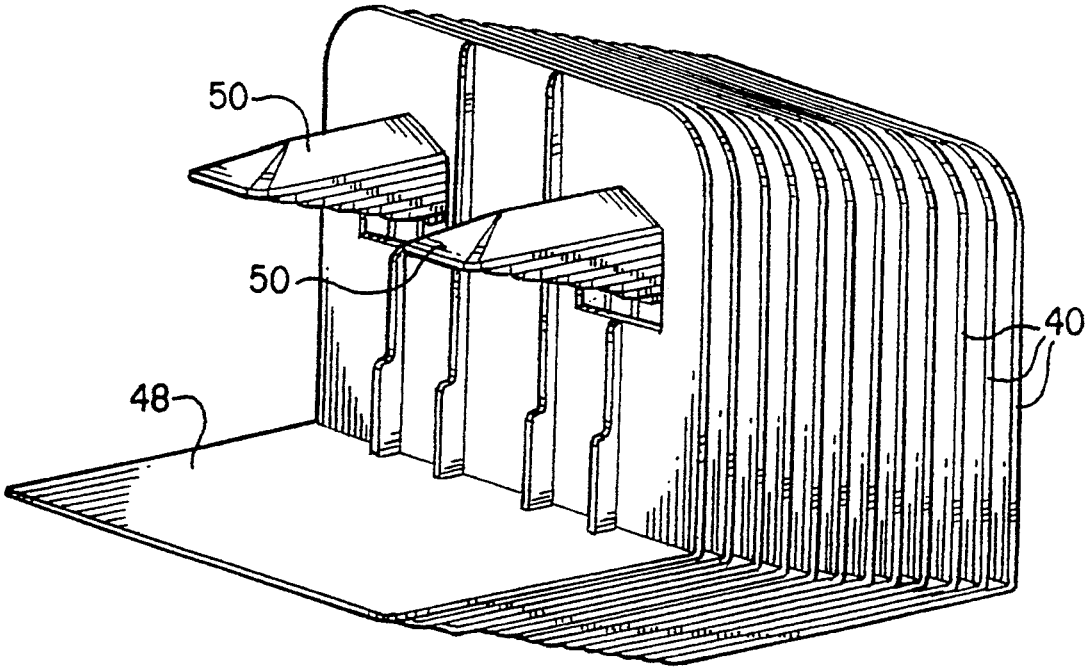
FIG. 5 shows a plurality of the retaining devices of FIG. 4 in a stacked configuration prior to use.

A second embodiment is shown with reference to FIGS. 4 and 5. Like numerals represent elements similar to those described above. This embodiment is similar to the previous embodiment, but is preferably formed from plastic by an injection molding process. The first wall 42 is extended upwardly beyond tabs 50 so that tabs 50 are located intermediate upper edge 44 and lower edge 46. Additionally, tabs 50 are formed into a three-dimensional polygonal shape. Apertures 52 provided immediately below each tab 50 are sized equal to or slightly greater than the size of the tabs to allow stacking of a plurality of retaining devices 40 as shown in FIG. 5. The stackability of this second embodiment retaining device 40 makes it suited for automated handling and assembly to print ribbon cartridges 10. Instead of separate apertures for each tab, one large aperture alternatively can be provided. The one large aperture would extend beneath both tabs 50. Additionally, vertically extending reinforcing ribs 54 can be provided to enhance the stiffness and rigidity of retaining device 40.

Figure 6:
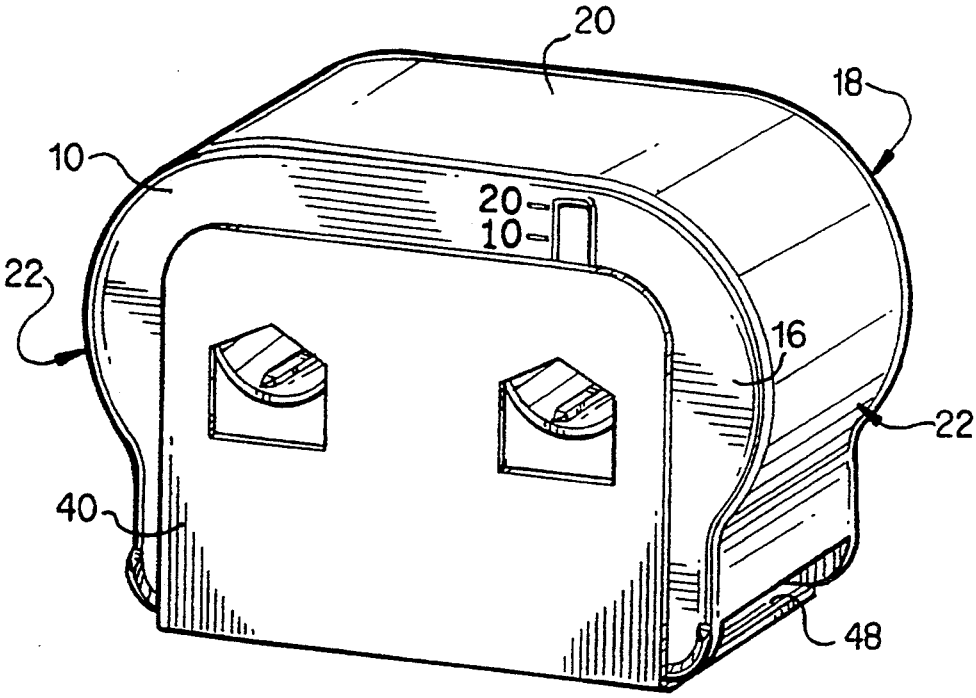
FIG. 6 shows the spool retaining device of FIG. 4 attached to the ribbon cartridge of FIG. 1.

In use, the spool retaining device 40 according to either of the embodiments is attached to the cartridge 10 as shown in FIG. 6. Tabs 50 extend through apertures 26 and engage with splines 34 of spools 30 and 32. First wall 42 of device 40 is mated substantially against front wall 16 of cartridge 10. Protruding support wall 48 extends below ribbon 28 to protect the exposed portion thereof. In this attached configuration, the ribbon 28 is prevented from unwinding by engagement of tabs 50 with splines 34. As previously described, this applies a tension to the ribbon, helping to maintain the ribbon in a tight, linear plane for easier insertion into the printing device. Note that top wall 20, sides 22 and back wall 18 of cartridge 10 are not covered by the retaining device 40 (i.e., these surfaces remain exposed) when device 40 is attached to the cartridge 10. This allows retaining device 40 to remain attached to cartridge 10 during installation of cartridge 10 into a printing device, which further ensures that the ribbon will not be damaged or become slack during installation onto the printing mechanism of a printing device.

Figure 7:
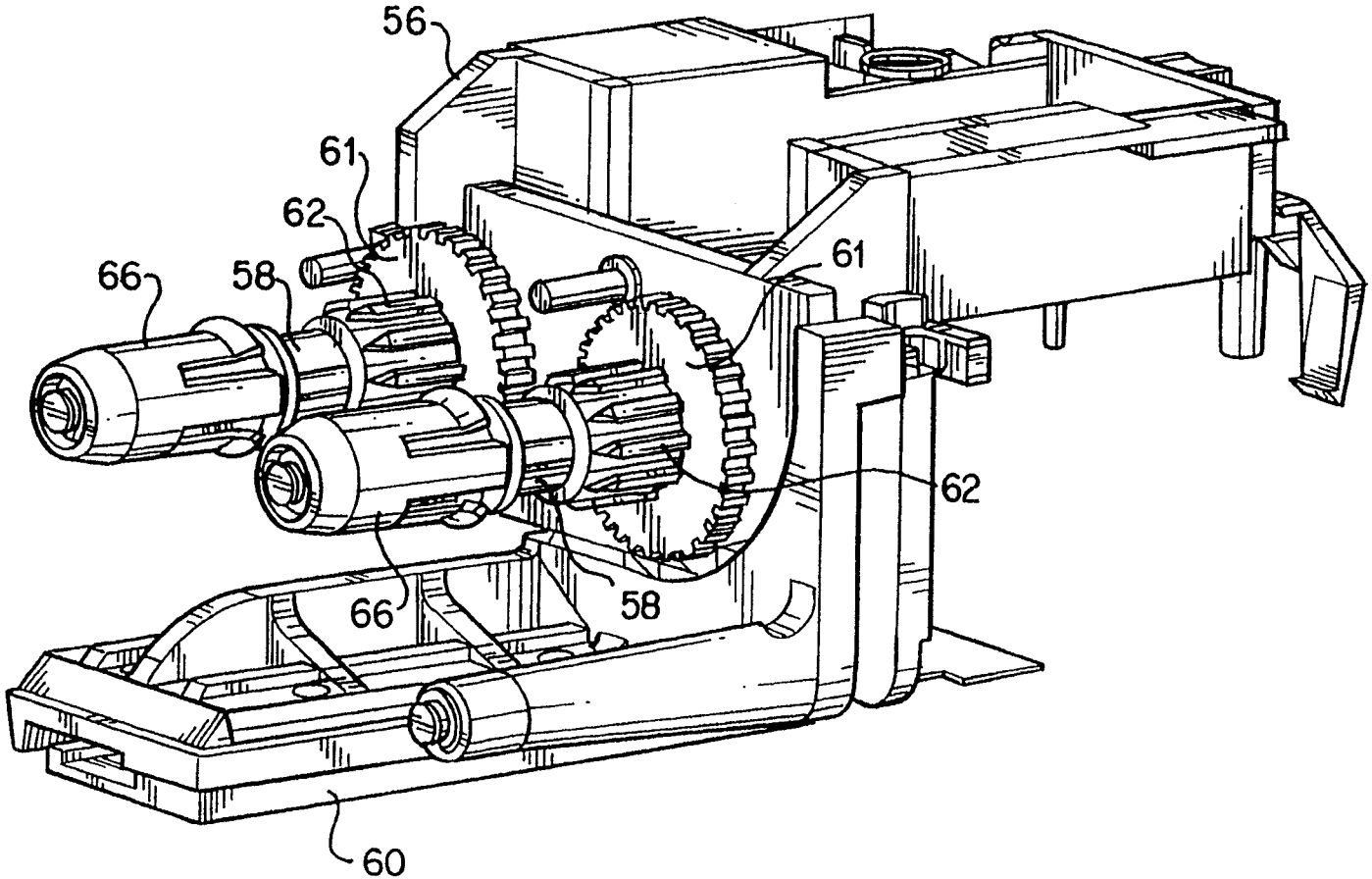
FIG. 7 shows a printing device mounting structure for receiving and retaining ribbon cartridges on a printing mechanism.
Figure 8:
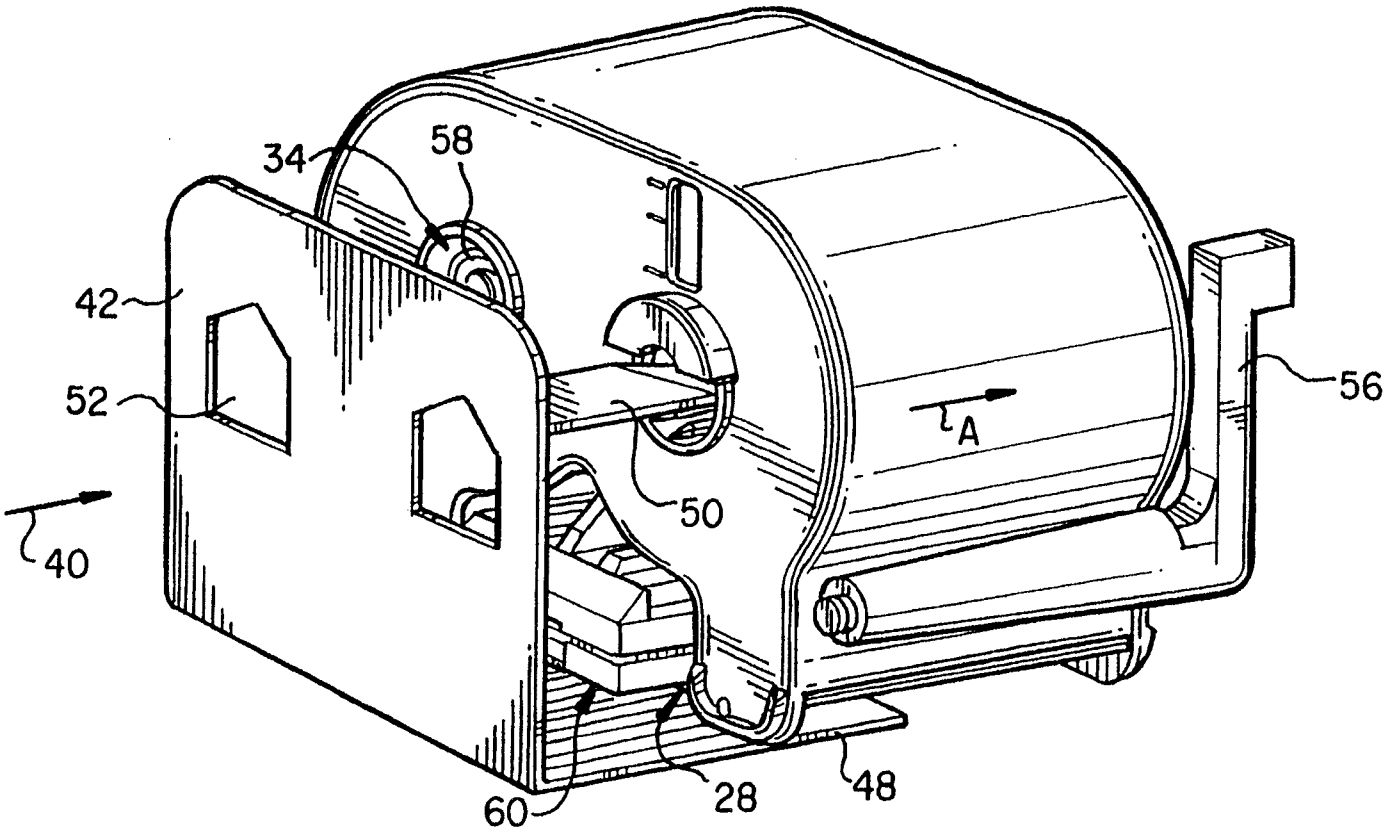
FIG. 8 shows the ribbon cartridge and attached retaining and installation device of FIG. 6 being installed onto the mounting structure of FIG. 7.

A typical printing device mounting arrangement is shown in FIG. 7 and can consist of a mounting frame 56 and shafts 58. Shafts 58 can be drive elements (for rotating the cartridge spools 30,32) or, as shown in FIG. 7, additional rotatably driven elements 61 can be provided rotatably on shafts 58 for engaging the splines 34 to drive spools 30,32. The specific spool driving structure, however, is not important to the present invention. The FIG. 7 exemplary driving structure comprises rotatable drive members 61 mounted on shafts 58. Drive splines 62 that mate and engage splines 34 on spools 30,32 of the cartridge 10 are provided on drive members 61. A retaining member 66 resiliently engages recesses (not shown) on the inner surface of spools 30,32 to hold the cartridge 10 in place on the driving mechanism. This exemplary arrangement can be found in some thermal printing devices, for example. A printhead 60 is attached to the mounting frame 56 or otherwise positioned (FIGS. 7 and 8). A platen (not shown) for supporting a recording medium (not shown) is provided below and spaced from the printhead 60 in FIG. 8. The exposed portion of ribbon 28 must be inserted in the small space between the printhead 60 and the platen.

To install the cartridge 10 into the printing device while the retaining device is attached, the cartridge is inserted with the cartridge back wall 18 facing shafts 58 and aligned so that shafts 58 are directly opposed to apertures 26 and spools 30, 32. The cartridge 10 is then inserted in the direction of the arrow A shown in FIG. 8 until the shafts 58 extend into spools 30,32 and the driving mechanism engages splines 34. Because of the structural design of the inventive retaining device 40, device 40 not only allows easy insertion of the cartridge into the printing device by supporting and retaining the exposed ribbon 28 under tension, but also automatically detaches from cartridge 10 in a direction opposite the arrow A as the cartridge is inserted. The length of tabs 50 can be selected so that upon full insertion of cartridge 10 onto shafts 58, retaining device 40 is completely detached.

The retaining device 40 can then be either discarded or stored and again attached to cartridge 10 upon depletion of the useful life of the ribbon, preventing contact between ribbon 28 and surrounding materials or users prior to and during disposal.

The invention has been described with reference to the preferred embodiments thereof, which are illustrative and not limiting. Various changes may be made without departing from the spirit and scope of the invention as defined in the appended claims.

What is claimed is:

1. A ribbon cartridge and retaining device comprising:

a ribbon cartridge housing rotatably supporting a supply spool having a supply of ribbon wound therearound and a take-up spool, at least one side of said housing having apertures sized to expose driving splines of said supply spool and said take-up spool, a portion of said ribbon extending between said supply spool and said take-up spool being arranged relative to one end of the housing so that said portion of said ribbon is exposed as the ribbon travels between said supply spool and said take-up spool; and a retaining device removably engaged with said ribbon cartridge, the retaining device comprising a first wall, two spaced apart tabs projecting in a direction perpendicular to said first wall and a protruding second wall extending in said direction from said first wall substantially parallel with said tabs, each of said tabs being sized and spaced to be removably fitted within respective ones of said apertures of said housing and engage said supply spool and take-up spool driving splines, wherein when said retaining device and said ribbon cartridge are engaged, said first wall of said retaining device is opposed to said one side of said housing, said protruding wall extends adjacent said one end of said housing covering said exposed portion of said ribbon, and a side of said housing opposite said one side is completely exposed allowing insertion of said ribbon cartridge into a ribbon driving device without prior removal of said retaining devices, said tabs forming a disengaging mechanism that disengages said retaining device from said ribbon cartridge during said insertion.

2. The ribbon cartridge and retaining device of claim 1, further comprising at least one aperture located in said retaining device first wall and sized to receive said tabs allowing nested stacking of retaining devices prior to use.

3. The ribbon cartridge and retaining device of claim 1, wherein said retaining device is formed from a folded sheet of plastic.

4. The ribbon cartridge and retaining device of claim 3, wherein said sheet of plastic has a thickness of about 0.5 millimeters.

5. The ribbon cartridge and retaining device of claim 1, wherein said retaining device is formed of injection molded plastic.

6. The ribbon cartridge and retaining device of claim 5, wherein a plurality of ribs are located on said first wall extending from said protruding wall toward said tabs.

7. The ribbon cartridge and retaining device of claim 1, wherein a surface of said ribbon is coated with ink.

8. A ribbon cartridge retaining and installation device consisting essentially of:

a substantially planar first wall;

two spaced apart tabs projecting in a direction perpendicular to said first wall, said two spaced apart tabs are mateable with splines within spools of a ribbon cartridge to prevent relative movement between the spools;

a protruding second wall extending in said direction from a lower end of said first wall substantially parallel with said tabs;

said substantially planar first wall, two spaced apart tabs and second wall forming a means for retaining a ribbon cartridge before installation; and said two spaced apart tabs forming a means for separating the device from a ribbon cartridge during installation.

9. The ribbon cartridge retaining and installation device of claim 8, wherein spaced apertures sized at least as large as said tabs are provided in said first wall adjacent to said tabs to allow nested stacking of a plurality of said ribbon cartridge retaining and installation devices prior to use.

10. The ribbon cartridge retaining and installation device of claim 8, wherein said device is formed from a folded sheet of plastic.

11. The ribbon cartridge retaining and installation device of claim 10, wherein said sheet of plastic has a thickness of about 0.5 millimeters.

12. The ribbon cartridge retaining and installation device of claim 8, wherein said device is formed of injection molded plastic.

13. The ribbon cartridge retaining and installation device of claim 12, wherein a plurality of ribs are located on said first wall extending substantially from said protruding second wall toward said tabs.

14. A method of installing a ribbon cartridge onto mounting elements of a ribbon driving device, said ribbon cartridge including: a housing having a front surface and a rear surface that face in opposite directions, a hollow supply spool and a hollow take-up spool rotatably mounted to and extending between said front surface and said rear surface, a ribbon wound on said supply spool and extending between said supply spool and said take-up spool, a portion of said ribbon that extends between said supply spool and said take-up spool being exposed along an outer portion of said housing, said front surface and said rear surface each having a pair of apertures aligned with said supply spool and said take-up spool so that inner surfaces of said supply spool and said take-up spool can be accessed through said front surface and through said rear surface; said method comprising the steps of:

providing a retaining device having a first wall, two spaced apart tabs projecting perpendicular to the first wall in a direction, and a protruding second wall extending from the first wall substantially in said direction;

attaching said retaining device to said ribbon cartridge so that:

each of said spaced apart tabs is inserted through a respective one of said pair of apertures on the front surface of said ribbon cartridge and engage the inner surfaces of the supply spool and the take-up spool to prevent said supply spool and said take-up spool from rotating, the first wall is adjacent to said front surface of the cartridge, and the protruding wall extends adjacent to and protects the exposed portion of the ribbon, said rear surface of said housing being completely exposed;

installing the ribbon cartridge onto the mounting elements of the ribbon driving device while the retaining device is initially attached to the cartridge and removing the retaining device from the cartridge during the installing.

15. The method of claim 14, wherein said removing step is performed automatically during the installation of the cartridge onto the mounting element.

16. The method of claim 14, wherein said ribbon is a print ribbon having ink coated on one surface, and said installing step includes positioning the exposed portion of ribbon into a gap between a printhead and a platen of a printing mechanism.

17. The method of claim 14, wherein said installing step and said removing step include:

inserting the mounting elements into the pair of apertures in the rear surface of said cartridge housing; and moving the cartridge toward said ribbon driving device so that said mounting members are inserted into said hollow supply spool and into said hollow take-up spool and displace said spaced apart tabs of said retaining device out of said supply spool and said take-up spool.

18. The method of claim 14, wherein said exposed portion of said ribbon engages with and is maintained in a flat plane by said protruding wall of said retaining device.

19. The method of claim 14, wherein said inner surfaces of said supply spool and of said take-up spool include splines, and said spaced apart tabs of said retaining device engage said splines.

20. The method of claim 14, wherein said ribbon includes ink on one surface and the cartridge is installed on the mounting elements of a printing mechanism.

21. A ribbon cartridge and retaining device comprising:

a ribbon cartridge including a housing having a front surface and a rear surface that face in opposite directions, a hollow supply spool and a hollow take-up spool rotatably mounted to and extending between said front surface and said rear surface, a ribbon wound on said supply spool and extending between said supply spool and said take-up spool, a portion of ribbon that extends between said supply spool and said take-up spool being exposed along an outer portion of said housing, said front surface and said rear surface each having a pair of apertures aligned with said supply spool and said take-up spool so that inner surfaces of said supply spool and said take-up spool can be accessed through said front surface and through said rear surface; and a retaining device removably engaged with said ribbon cartridge, the retaining device including a first wall, two spaced apart tabs projecting in a direction perpendicular to said first wall and a protruding second wall extending in said direction from said first wall substantially parallel with said tabs, each of said tabs being removably fitted within respective ones of said apertures of said front surface and engaging the inner surfaces of one of said supply spool and take-up spool, wherein, when said retaining device and said ribbon cartridge are engaged, said first wall of said retaining device is opposed to said front surface of said ribbon cartridge housing, said protruding wall extends adjacent to said exposed portion of said ribbon, and the rear surface of said ribbon cartridge housing is completely exposed allowing insertion of said ribbon cartridge into a ribbon driving device without prior removal of said retaining device, said tabs forming a disengaging mechanism that disengages said retaining device from said ribbon cartridge during said insertion.

22. The ribbon cartridge and retaining device of claim 21, further comprising at least one aperture located in said first wall adjacent to said tabs, and sized to receive said tabs allowing nested stacking of retaining devices prior to use.

23. The ribbon cartridge and retaining device of claim 22, wherein said first wall includes a pair of apertures, each of said apertures located between said protruding wall and a respective one of said tabs.

24. The ribbon cartridge and retaining device of claim 22, wherein said inner surfaces of said supply spool and of said take-up spool include splines, and said spaced apart tabs of said retaining device engage said splines.

* * * * *